US006508218B2

(12) United States Patent
Fukuzawa et al.

(10) Patent No.: US 6,508,218 B2
(45) Date of Patent: Jan. 21, 2003

(54) INTAKE SYSTEM FOR HORIZONTAL OPPOSED TYPE INTERNAL COMBUSTION ENGINE

(75) Inventors: Kazuto Fukuzawa, Saitama (JP); Makoto Sanada, Saitama (JP); Minoru Matsuda, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/988,005

(22) Filed: Nov. 16, 2001

(65) Prior Publication Data

US 2002/0056431 A1 May 16, 2002

Related U.S. Application Data

(60) Provisional application No. 60/248,556, filed on Nov. 16, 2000.

(30) Foreign Application Priority Data

Nov. 16, 2000 (JP) ..... 2000-349948
Oct. 30, 2001 (JP) ..... 2001-333339

(51) Int. Cl.[7] ..... F02M 35/10
(52) U.S. Cl. ..... 123/184.28; 123/184.21
(58) Field of Search ..... 123/184.28, 54.1, 123/54.2, 54.3, 54.4, 54.5, 54.6, 54.7, 184.21

(56) References Cited

U.S. PATENT DOCUMENTS 3,845,746 A * 11/1974 Elsbett ..... 123/184.42
6,425,363 B1 * 7/2002 Lieske et al. ..... 123/184.21

* cited by examiner

*Primary Examiner*—Willis R. Wolfe
*Assistant Examiner*—Mahmoud Gimie
(74) *Attorney, Agent, or Firm*—Birch, Stewart, Kolasch & Birch, LLP.

(57) ABSTRACT

An intake system for a horizontally opposed type internal combustion engine can contribute to an improvement in output performance without sacrificing the intrinsic merit of the horizontally opposed type internal combustion engine. Specifically, the intake system ensures that the overall height of the engine remains small. First and second intake ports are provided at head portions of first and second banks, which are arranged on the left and right sides. First and second intake distribution ports are arranged horizontally at a front wall of an intake surge tank 10, which is disposed on the rear end side of and adjacent to a crankshaft 1. The first and second intake ports are respectively connected with each other through first and second intake pipes disposed along a top surface or bottom surface of the engine E. Throttle valves for controlling intake quantities in the first and second intake pipes are provided in upstream portions of the intake pipes.

20 Claims, 7 Drawing Sheets

INTAKE SYSTEM FOR HORIZONTAL OPPOSED TYPE INTERNAL COMBUSTION ENGINE

CROSS-REFERENCES TO RELATED APPLICATIONS

This nonprovisional application claims priority under 35 U.S.C. §119(a) on Patent Application No. 2000-349948 filed in Japan on Nov. 16, 2000, and Patent Application No. 2001-333339 filed in Japan on Oct. 30, 2001, the entirety of each of which is herein incorporated by reference. This nonprovisional application further claims priority under 35 U.S.C. §119(e) on U.S. Provisional Application No. 60/248,556, filed on Nov. 16, 2000, the entirety of which is herein incorporated by reference.

BACKGROUND OF THE INVENTION

1. Field of the Invention

The present invention relates to an intake system for a horizontally opposed type internal combustion engine which includes a first bank and a second bank horizontally disposed opposite to each other with a crankshaft therebetween.

2. Description of Background Art

An intake system for a horizontally opposed type internal combustion engine according to the background art includes branch pipes of an intake manifold extending vertically as a whole and connected to intake ports opening at top surfaces of head portions of first and second banks. Furthermore, an evaporator or a throttle body is connected to a distribution chamber provided at an upper portion of the intake manifold, and an air cleaner is connected thereto.

However, since the intake system as described above is constructed with concentration on the upper side of the first and second banks, the overall height of the engine is increased. This reduces the intrinsic merit of a horizontally opposed type internal combustion engine, which is intended to decrease the overall height of the engine by arranging the first and second banks horizontally.

SUMMARY OF THE INVENTION

The present invention has been made in view of the above-mentioned point. It is therefore an object of the present invention to provide an intake system for a horizontally opposed type internal combustion engine which can obviate the damage to the abovementioned intrinsic merit of the horizontally opposed type internal combustion engine, and can contribute to improvement in output performance of the engine.

In order to attain the above-mentioned object, a horizontally opposed type internal combustion engine includes a first bank and a second bank horizontally disposed opposite to each other with a crankshaft therebetween. First and second intake ports are provided at head portions of the first and second banks. A side wall on the crankshaft side of an air cleaner disposed horizontally adjacent to and on one end side of the crankshaft is provided with first and second intake distribution ports corresponding to the first and second intake ports and arranged horizontally. The first and second intake ports and the first and second intake distribution ports are connected respectively to each other through first and second intake pipes disposed along a top surface or a bottom surface of the engine. Furthermore, throttle valves for controlling intake quantities in the first and second intake pipes are provided in respective upstream portions of the intake pipes.

According to the first characteristic feature, even distribution of air into the first and second intake pipes is achieved in the air cleaner, and the distributed air is supplied individually into first and second cylinders. As a result, interference of the intake between the cylinders is restrained, while charging efficiency can be enhanced, and an improvement in output performance of the engine can be accomplished.

In addition, the air cleaner disposed horizontally adjacent to and on the rear end side of the crankshaft and the first and second intake pipes arranged along a top surface or bottom surface of the engine do not have a large influence on the overall height of the engine. Therefore, it is possible to retain the intrinsic merit of the horizontally opposed type internal combustion engine such that the overall height of the engine can remain small.

In addition to the first characteristic feature, the first and second banks include pluralities of first and second cylinders and pluralities of the first and second intake ports corresponding to the first and second cylinders. Pluralities of the first and second intake distribution ports provided in the air cleaner corresponding to the first and second intake ports are arranged symmetrically with respect to a center line extending in the vicinity of and in parallel with the crankshaft. The first and second intake ports nearer to the air cleaner and the first and second intake distribution ports located on the inner side and nearer to the center line are connected respectively to each other through the first and second intake pipes. The first and second intake ports farther from the air cleaner and the first and second intake distribution ports located on the outer side and farther from the center line are connected respectively to each other through the first and second intake pipes. Furthermore, valve shafts of the throttle valves provided in the upstream portions of the first and second intake pipes are connected coaxially with each other.

According to the second characteristic feature, although the distances from the front-side and rear-side intake ports to the air cleaner differ in each of the banks, evening of the effective pipe lengths of the first intake pipes and evening of the effective pipe lengths of the second intake pipes can be accomplished, and inertia effects and pulsation effects of the intake can be evenly displayed in each of the intake pipes. As a result, charging efficiency for the cylinders can be enhanced effectively, and a further improvement in output performance can be accomplished.

Furthemore, in addition to the first characteristic feature, the first and second banks include pluralities of the first and second cylinders and pluralities of the first and second intake ports corresponding to the first and second cylinders. Pluralities of the first and second intake distribution ports provided in the air cleaner corresponding to the first and second intake ports are arranged symmetrically with respect to the center line extending in the vicinity of and in parallel with the crankshaft. The first and second intake ports nearer to the air cleaner and the first and second intake distribution ports located on the outer side and farther from the center line are connected respectively to each other through the first and second intake pipes. The first and second intake ports farther from the air cleaner and the first and second intake distribution ports located on the inner side and nearer to the center line are connected respectively to each other through the first and second intake pipes. Furthermore, the throttle valves provided in the upstream portions of the first and second intake pipes connected to the first and second outer-side intake distribution ports are arranged nearer to the air cleaner as compared to the throttle valves provided in the upstream portions of the first and second intake pipes connected to the first and second inner-side intake distribution ports.

According also to the third characteristic feature, evening of the effective pipe lengths of the first intake pipes and evening of the effective pipe lengths of the second intake pipes can be accomplished, and inertia effects and pulsation effects of the intake in each of the intake pipes can be displayed more evenly. As a result, charging efficiency for each of the cylinders can be enhanced effectively, and a further improvement in output performance can be contrived.

Furthermore, in addition to the third characteristic feature, the fourth characteristic feature includes the valve shafts of the throttle valves nearer to the air cleaner connected coaxially with each other, and the valve shafts of the throttle valves farther from the air cleaner connected coaxially with each other.

According to the fourth characteristic feature, the valve shaft of the throttle valves nearer to the air cleaner and the valve shaft of the throttle valves farther from the air cleaner can be arranged parallel with each other.

Furthermore, in addition to the third characteristic feature, the fifth characteristic feature includes the valve shafts of the throttle valves in the first intake pipes connected coaxially with each other, and the valve shafts of the throttle valves in the sec and intake pipes connected coaxially with each other.

According to the fifth characteristic feature, interchangeability between the valve shaft of the throttle valves nearer to the air cleaner and the valve shaft of the throttle valves farther from the air cleaner can be accomplished.

Furthermore, in addition to any one of the first to fifth characteristic features, the sixth characteristic feature includes the first bank set off from the second bank to the opposite side of the air cleaner along the axis line of the crankshaft, and the center line set off from the axis line of the crankshaft to the side of the first bank.

According to the sixth characteristic feature, the difference between the lengths of the first intake pipe and the second intake pipe due to offset of the first and second banks from each other can be reduced. This contributes to evening of the effective pipe lengths of the first and second intake pipes.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF PREFERRED EMBODIMENTS

Figure 1:
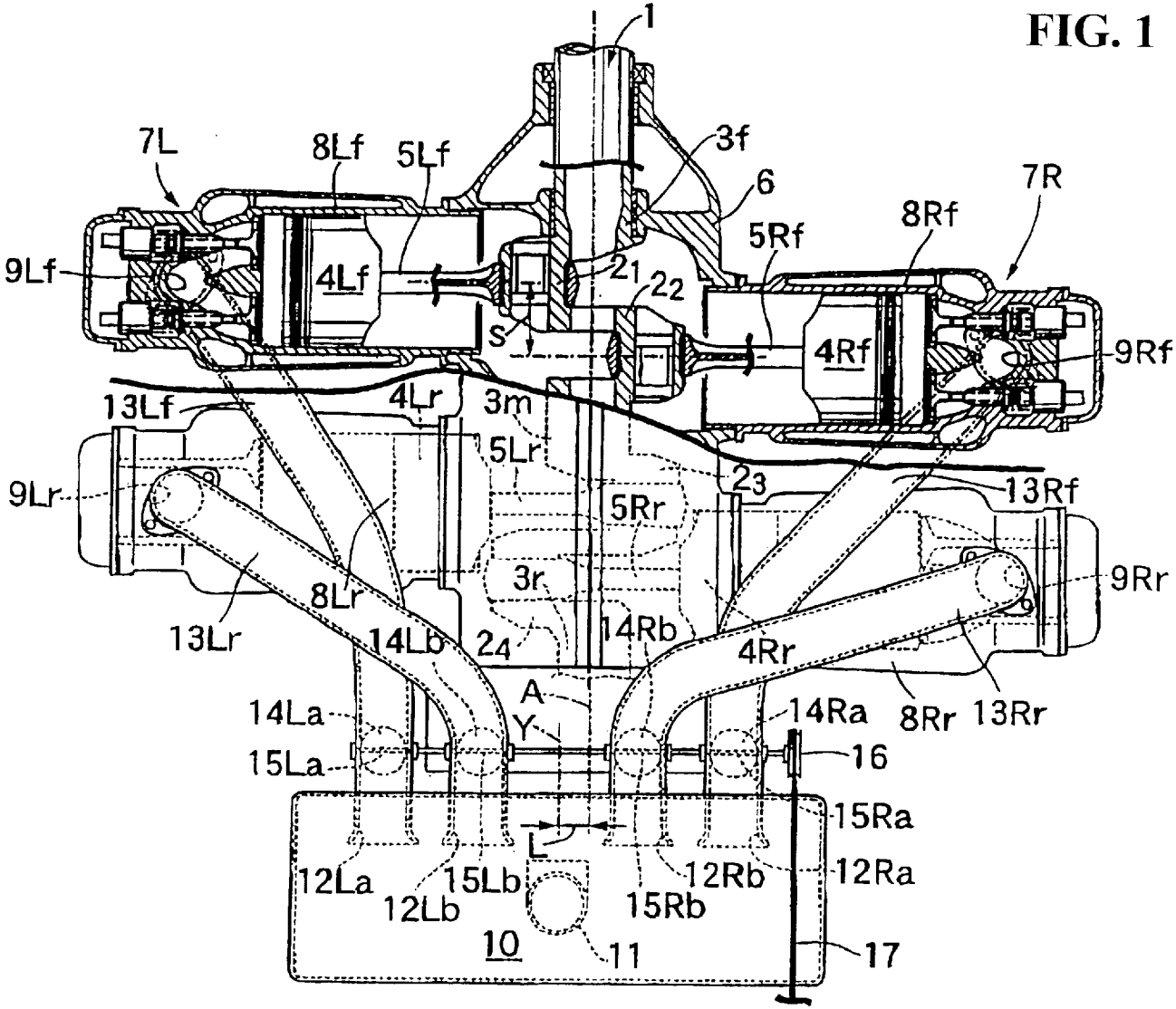
FIG. 1 is a plan view of a horizontally opposed type internal combustion engine including an intake system according to the first embodiment of the present invention.

The present invention will now be described with reference to the accompanying drawings, wherein the same reference numerals are used to identify the same or similar elements.

Figure 2:
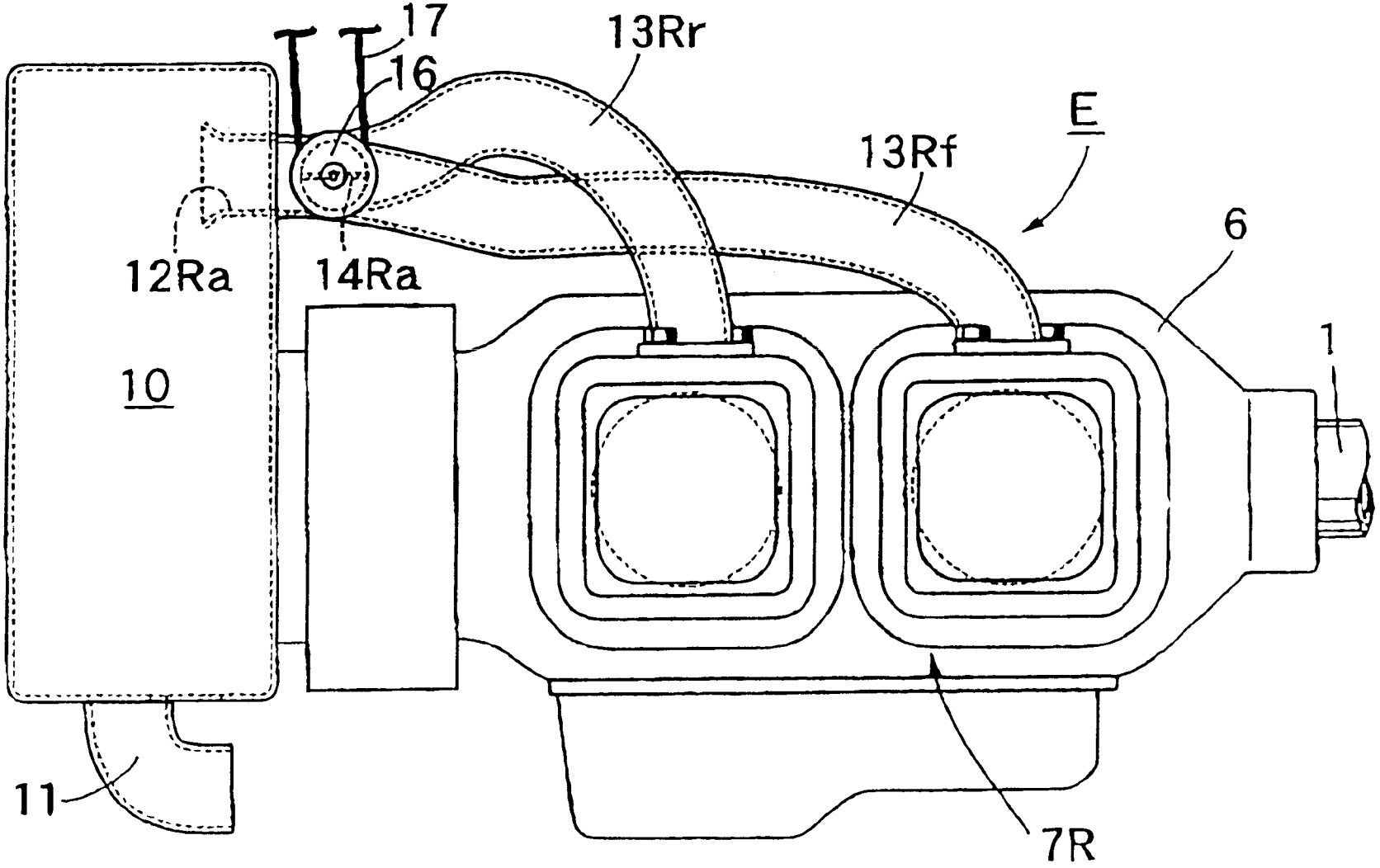
FIG. 2 is a side view of the internal combustion engine.
Figure 3:
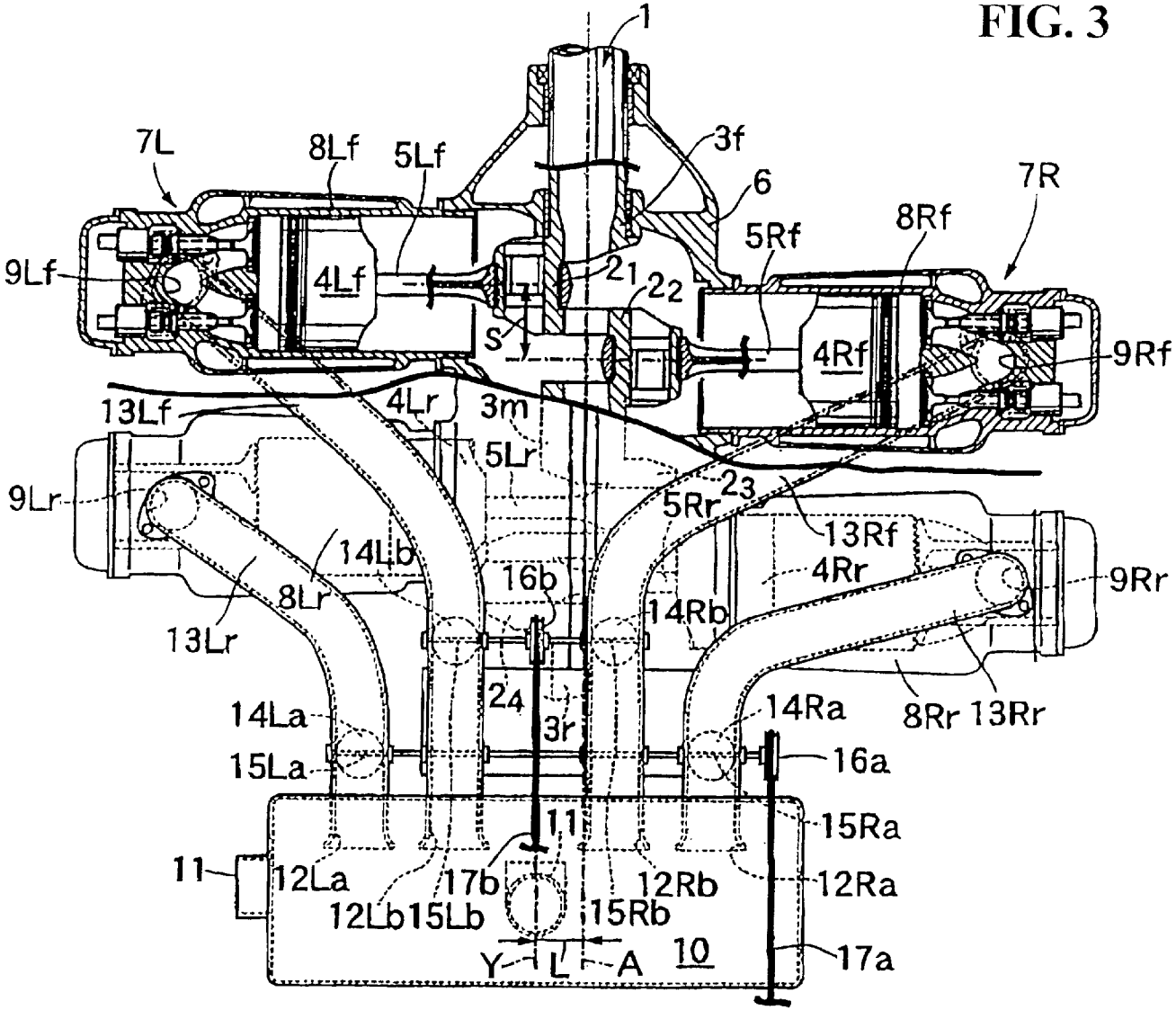
FIG. 3 is a plan view of a horizontally opposed type internal combustion engine including an intake system according to the second embodiment of the present invention.
Figure 4:
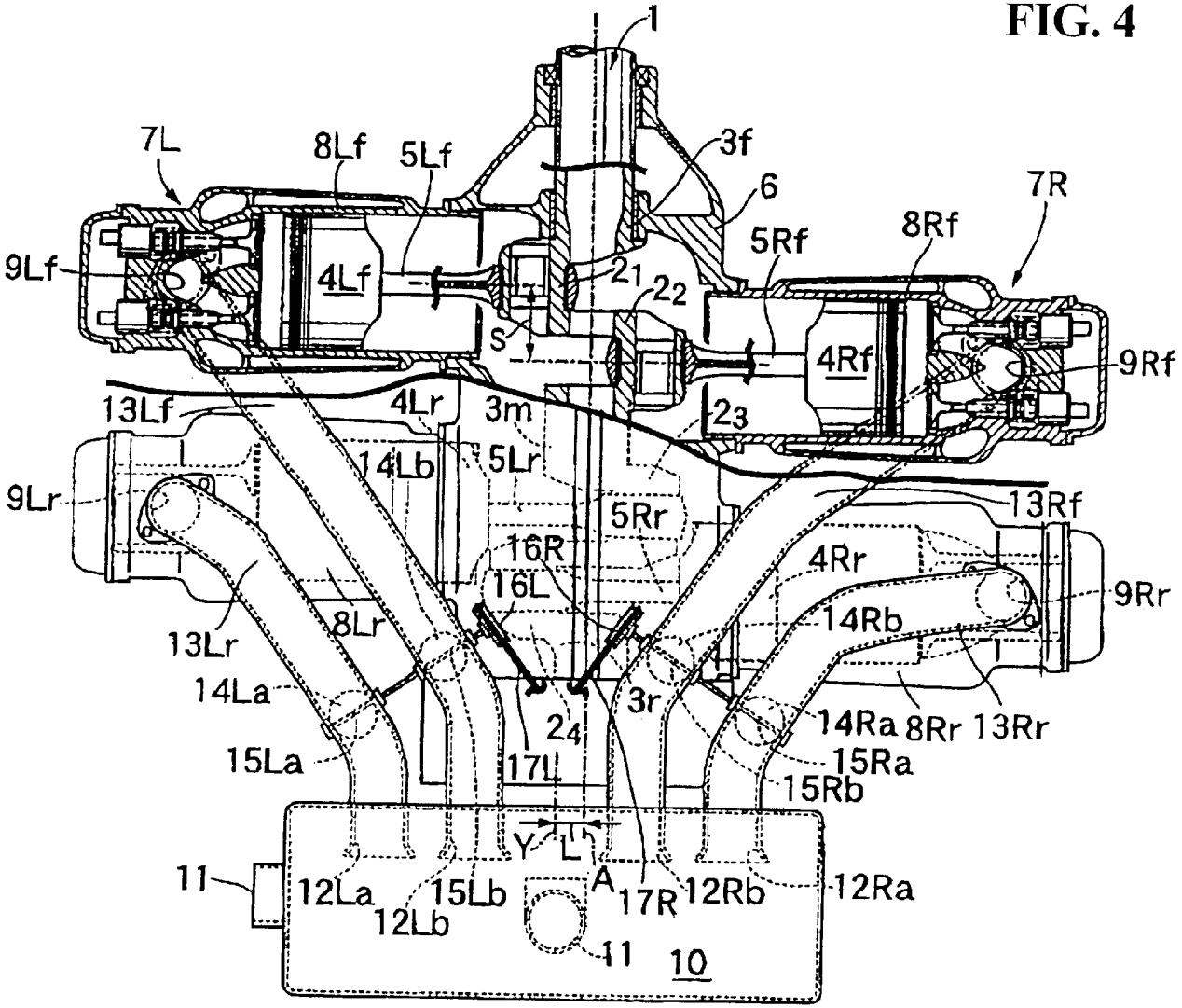
FIG. 4 is a plan view of a horizontally opposed type internal combustion engine including an intake system according to the third embodiment of the present invention.
Figure 5:
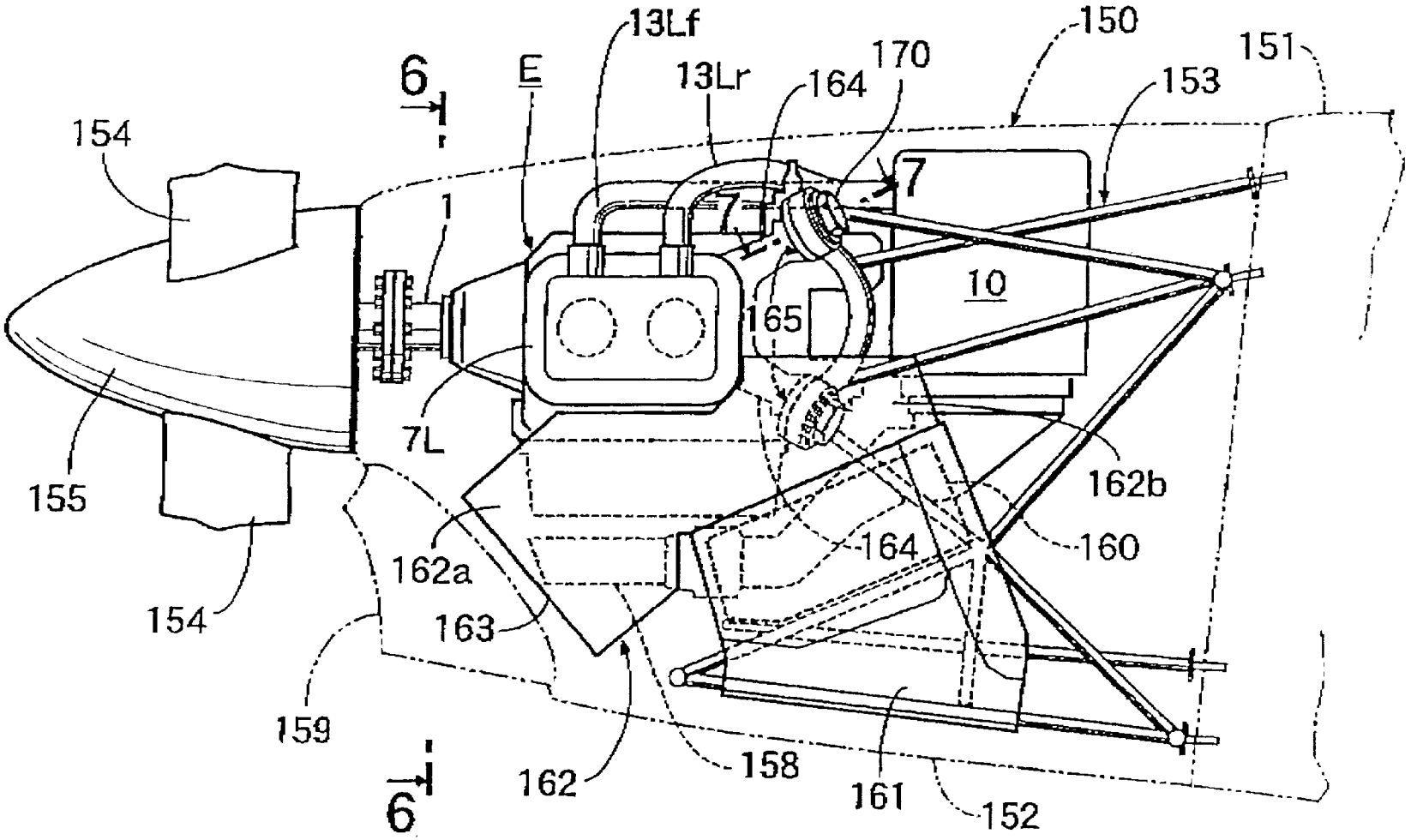
FIG. 5 is a side elevational view showing an engine installed in an airplane.
Figure 6:
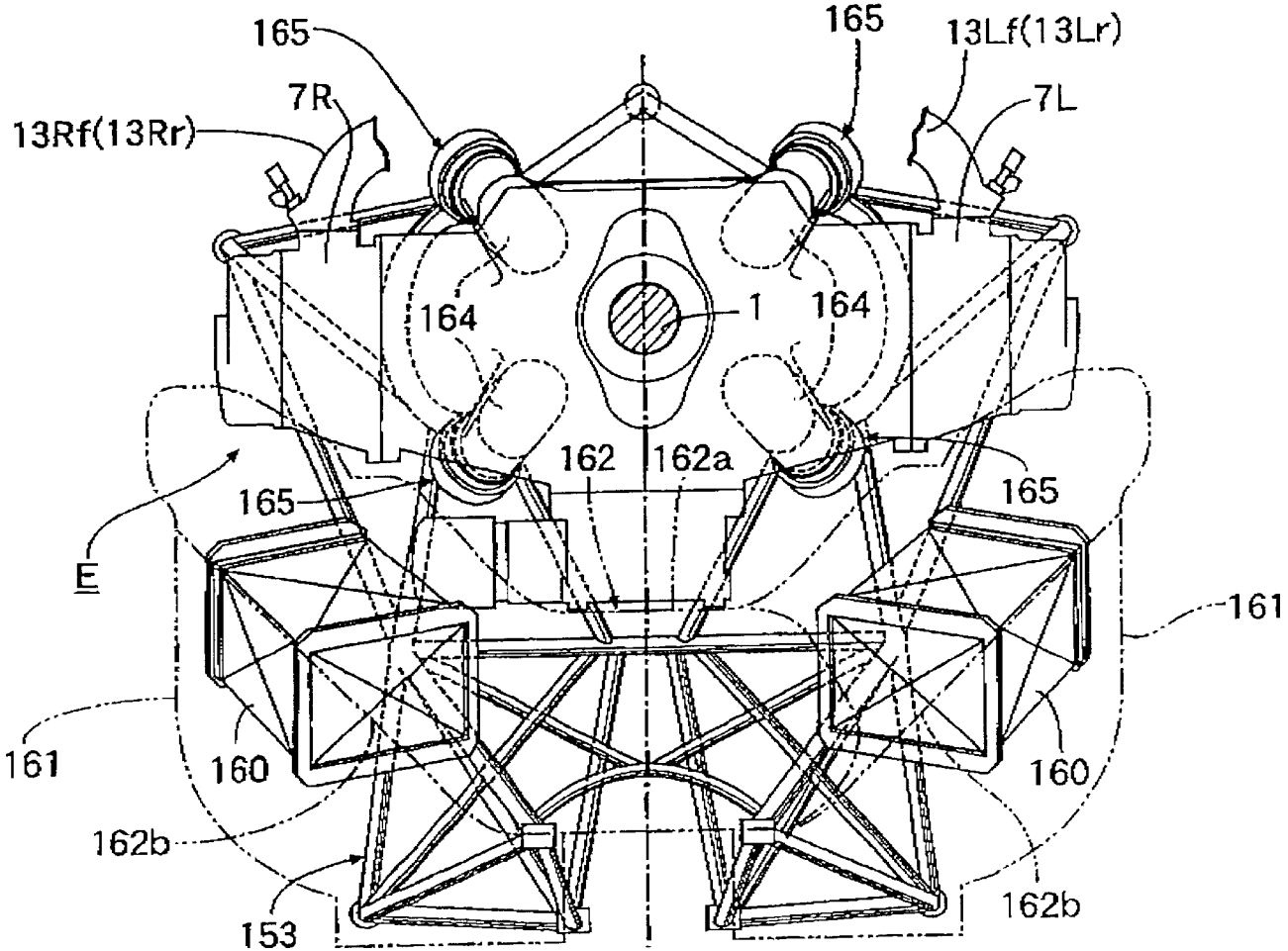
FIG. 6 is a sectional view along line 6—6 of FIG. 5.
Figure 7:
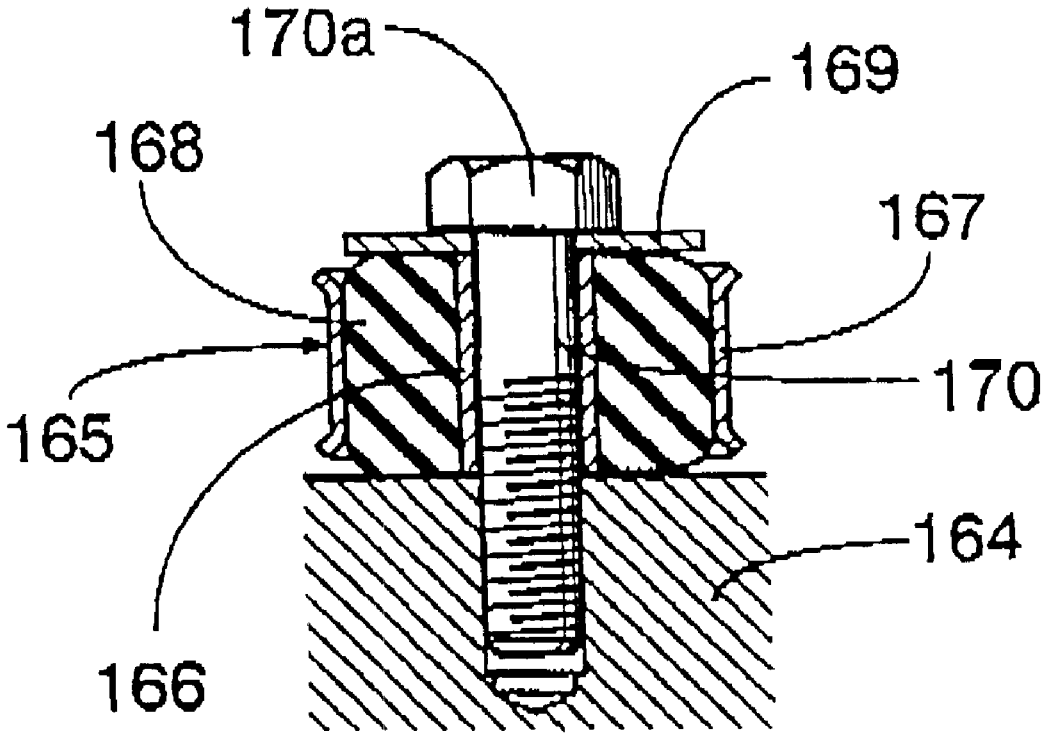
FIG. 7 is an enlarged sectional view along line 7—7 of FIG. 5.

FIG. 1 is a plan view of a horizontally opposed type internal combustion engine including an intake system according to the first embodiment of the present invention; FIG. 2 is a side view of the internal combustion engine; FIG. 3 is a plan view of a horizontally opposed type internal combustion engine including an intake system according to the second embodiment of the present invention; FIG. 4 is a plan view of a horizontally opposed type internal combustion engine including an intake system according to the third embodiment of the present invention; FIG. 5 is a side elevational view showing an engine installed in an airplane; FIG. 6 is a sectional view along line 6—6 of FIG. 5; and FIG. 7 is an enlarged sectional view along line 7—7 of FIG. 5.

The first embodiment of the present invention will now be described with reference to FIGS. 1 and 2. In FIG. 1, symbol E denotes a horizontally opposed type 4-cylinder internal combustion engine for a vehicle to which the present invention has been applied. In the internal combustion engine E, a crankshaft 1 is disposed in the front-rear direction of the vehicle. The crankshaft 1 includes No. 1 crank $\mathbf{2}_1$, No. 2 crank $\mathbf{2}_2$, No. 3 crank $\mathbf{2}_3$, and No. 4 crank $\mathbf{2}_4$. The crank $\mathbf{2}_1$ and the crank $\mathbf{2}_4$ as well as the crank $\mathbf{2}_2$ and the crank $\mathbf{2}_3$ are respectively in the same phase with each other, and there is a phase difference of 180° between the cranks $\mathbf{2}_1$, $\mathbf{2}_4$ and the cranks $\mathbf{2}_2$, $\mathbf{2}_3$. A front-rear pair of first pistons 4L*f*, 4L*r* are respectively connected to the cranks $\mathbf{2}_1$, $\mathbf{2}_4$ through connecting rods 5L*f*, 5L*r*, and a front-rear pair of second pistons 4R*f*, 4R*r* are respectively connected to the cranks 2*2*, $\mathbf{2}_4$ through connecting rods 4R*f*, 4R*r*. The first pistons 4L*f*, 4L*r* and the second pistons 4R*f*, 4R*r* are disposed opposite to each other on the left and right sides with the axis line A of the crankshaft 1 therebetween. The first pistons 4L*f*, 4L*r* are set off from the second pistons 4R*f*, 4R*r* to the front side along the crank axis line A by an axial distance S between the crank $\mathbf{2}_1$ and the crank $\mathbf{2}_2$ and between the crank $\mathbf{2}_3$ and the crank $\mathbf{2}_4$. The offset distance S corresponds to the offset distance between the first and second banks 7L, 7R, which will be described later.

The crankshaft 1 is provided with a front journal 3*f* adjacent to and on the front side of the crank $\mathbf{2}_1$, a middle journal 3*m* at a middle portion between the cranks $\mathbf{2}_2$, $\mathbf{2}_3$, and a rear journal 3*r* adjacent to and on the rear side of the crank $\mathbf{2}_4$. The journals 3*f*, 3*m* and 3*r* are rotatably supported by a crankcase 6.

On the left and right sides of the crankcase 6 are adjacently disposed the first and second banks 7L, 7R horizontally opposite to each other with the crankshaft 1 therebetween. The first and second banks 7L, 7R include front-rear pairs of first and second cylinders 8L*f*, 8L*r* and 8R*f*, 8R*r*. The first pistons 4L*f*, 4L*r* are fitted in the first cylinders 8L*f*, 8L*r*, while the second pistons 4R*f*, 4R*r* are fitted in the second cylinders 8R*f*, 8R*r*.

At head portions of the first and second banks 7L, 7R, first and second intake ports 9L*f*, 9L*r* and 9R*f*, 9R*r* corresponding to the respective cylinders 8L*f*, 8L*r* and 8R*f*, 8R*r* are provided opened at top surfaces of the head portions.

As shown in FIGS. 1 and 2, an air cleaner 10 is disposed on the rear side of the crankcase 6, horizontally adjacent to the rear end of the crankshaft 1. The air cleaner 10 has the shape of a box, elongate in the left-right direction. A bottom wall of the air cleaner 10 is provided with an air inlet 11. A front wall of the air cleaner 10 on the side of the crankcase 6 is provided with first and second intake distribution ports 12L*a*, 12L*b* and 12R*a*, 12R*b* corresponding to the first and second intake ports 9L*f*, 9L*r* and 9R*f*, 9R*r* of the first and second banks 7L, 7R. The first and second intake distribution ports 12L*a*, 12L*b* and 12R*a*, 12R*b* are disposed horizontally and symmetrically on the left and right sides of a center line Y parallel to the crankshaft 1, and are shaped like funnels opening into the air cleaner 10.

The center line Y is set off from the axis line A of the crankshaft 1 to the side of the first bank 7L by a distance L which corresponds to the frontward offset distance S of the first bank 7L relative to the second bank 7R.

The first and second rear-side intake ports 9L*r*, 9R*r* nearer to the air cleaner 10 and the first and second inner-side intake distribution ports 12L*b*, 12R*b* nearer to the center line Y are connected respectively to each other through first and second intake pipes 13L*r*, 13R*r*. The first and second front-side intake ports 9L*f*, 9R*f* farther from the air cleaner 10 and the first and second outer-side intake distribution ports 12L*a*, 12R*a* farther from the center line Y are connected respectively to each other through first and second intake pipes 13L*f*, 13R*f*. The first intake pipes 13L*f*, 13L*r* cross each other at an intermediate part, and the second intake pipes 13R*f*, 13R*r* also cross each other at an intermediate part. The first and second intake pipes 13L*r*, 13R*r* are disposed as a whole along a top surface of the engine E.

At upstream portions of the first and second intake pipes 13L*f*, 13L*r* and 13R*f*, 13R*r*, butterfly-type throttle valves 14L*a*, 14L*b* and 14R*a*, 14R*b* for individual control of intake quantities in the intake pipes are disposed in the direction of arrangement of the first and second intake distribution ports 12L*a*, 12L*b* and 12R*a*, 12R*b*. Valve shafts 15L*a*, 15L*b* and 15R*a*, 15R*b* of the throttle valves 14L*a*, 14L*b* and 14R*a*, 14R*b* are connected coaxially with each other. In the case shown in the figures, the valve shafts are composed of a long common single valve shaft, and a throttle drum 16 connected with an operating wire 17 is attached to one end of the common valve shaft.

The operation or effects of the first embodiment will now be described below.

During operation of the engine E, even distribution of air into the first and second intake pipes 13L*f*, 13L*r* and 13R*f*, 13R*r* is carried out in the air cleaner 10. The distributed air is supplied individually into the first and second cylinders 8L*f*, 8L*r* and 8R*f*, 8R*r*. In this manner, interference of the intake among the cylinders 8L*f*, 8L*r* and 8R*f*, 8R*r* can be prevented, while charging efficiency can be enhanced.

Especially, the first and second rear-side intake ports 9L*r*, 9R*r* nearer to the air cleaner 10 and the first and second inner-side intake distribution ports 12L*b*, 12R*b* nearer to the center line Y are respectively connected to each other through the first and second intake pipes 13L*r*, 13R*r*. The first and second front-side intake ports 9L*f*, 9R*f* farther from the air cleaner 10 and the first and second outer-side intake distribution ports 12L*a*, 12R*a* farther from the center line Y are respectively connected to each other through the first and second intake pipes 13L*f*, 13R*f*. In addition, throttle valves 14L*a*, 14L*b* and 14R*a*, 14R*r* are disposed in upstream portions of the first and second intake pipes 13L*f*, 13L*r* and 13R*f*, 13R*r*, arranged in the arrangement direction of the first and second intake distribution ports 12L*f*, 12L*r* and 12R*f*, 12R*r*. Therefore, although the distances between the front-side and rear-side intake ports 9L*f*, 9L*r* and 9R*f*, 9R*r* and the air cleaner 10 differ in each of the banks 7L, 7R, evening of the effective pipe lengths of the first intake pipes 13L, 13L*r* and evening of the effective pipe lengths of the second intake pipes 13R*f*, 13R*r* can be accomplished.

Furthermore, since the first and second intake distribution ports 12L*f*, 12L*r* and 12R*f*, 12R*r* are as a whole set off to the side of the first bank 7L by a distance L, which corresponds to the frontward offset distance S of the first bank 7L relative to the second bank 7R, the pipe length difference between the first intake pipes 13L*f*, 13L*r* and the second intake pipes 13R*f*, 13R*r* due to the offset of the first and second banks 7L, 7R from each other can be reduced.

As a result, inertia effects and pulsation effects of intake can be evenly displayed in each of the intake pipes 13L*f*, 13L*r* and 13R*f*, 13R*r*, charging efficiency for each of the cylinders 8L*f*, 8L*r* and 8R*f*, 8R*r* can be effectively enhanced, and an improvement in engine output can be accomplished.

In addition, the air cleaner 10 is disposed at the rear end of and horizontally adjacent to the crankshaft 1 while the first and second intake pipes 13L*f*, 13L*r* and 13R*f*, 13R*r* connecting the air cleaner 10 to the first and second intake ports 9L*f*, 9L*r* and 9R*f*, 9R*r* opening at top surfaces of head portions of the first and second banks 7L, 7R are laid along the top surface of the engine E. Accordingly, the intake pipes 13L*f*, 13L*r* and 13R*f*, 13R*r* and the air cleaner 10 are prevented from making a great effect on the overall height of the engine. Therefore, it is possible to make the most of the intrinsic merit of the horizontally opposed type internal combustion engine E such that the overall height of the engine can be made small.

A second embodiment of the present invention will now be described with reference to FIG. 3.

In the second embodiment, first and second intake ports 9L*r*, 9R*r* nearer to an air cleaner 10 and first and second outer-side intake distribution ports 12L*a*, 12R*a* farther from a center line Y in the air cleaner 10 are respectively connected to each other through first and second intake pipes 13L*r*, 13R*r*. First and second intake ports 9L*f*, 9R*f* farther from the air cleaner 10 and first and second inner-side intake distribution ports 12L*b*, 12R*b* nearer to the center line Y are respectively connected to each other through first and second intake pipes 13L*f*, 13R*f*. In addition, throttle valves 14L*a*, 14R*a* provided in upstream portions of the first and second intake pipes 13L*r*, 13R*r* connected to the first and second outer-side intake distribution ports 12L*a*, 12R*a* are disposed nearer to the air cleaner 10 as compared with throttle valves 14L*b*, 14R*b* provided in upstream portions of the first and second intake pipes 13L*f*, 13R*f* connected to the first and second inner-side intake distribution ports 12L*b*, 12R*b*. Valve shafts 15L*a*, 15R*a* of the rear-side throttle valves 14L*a*, 14R*a* are connected coaxially with each other so as to pierce through the first and second inner-side intake pipes 13L*f*, 13R*f*. In the embodiment illustrated, the valve shafts are composed of a long common single valve shaft, and a throttle drum 16*a* connected to an operating wire 17*a* is attached to one end of the common valve shaft. Valve shafts 15L*b*, 15R*b* of the front-side throttle valves 14L*b*, 14R*b* are connected coaxially with each other. In the embodiment illustrated, the valve shafts are composed of a long common single valve shaft, and a throttle drum 16*b* connected to an operating wire 17*b* is attached to an intermediate portion of the common valve shaft. Both the operating wires 17*a*, 17*b* are connected to a common throttle operating member, not shown, so that they are operated simultaneously. In addition, where the front-side and rear-side valve shafts 15L*b*, 15R*b* and 15L*a*, 15R*a* are connected to each other through a link mechanism, it suffices that the operating system is provided only for either one valve shaft 15L*b*, 15R*b* or 15L*a*, 15R*a*.

Other aspects of the construction of the second embodiment are the same as in the first embodiment. Therefore, the same reference symbols are used for the same component parts in FIG. 3 as in the first embodiment, and description of such component parts is omitted.

According to the second embodiment, the effective pipe lengths of the intake pipes 13L*f*, 13R*f* connecting the front-side intake ports 9L*f*, 9R*f* to the front-side throttle valves 14L*b*, 14R*b* and the effective pipe lengths of the intake pipes 13L*r*, 13R*r* connecting the rear-side intake ports 9L*r*, 9R*r* to the rear-side throttle valves 14L*a*, 14R*a* can be made more even in each of the banks 7L, 7R, and inertia effects and pulsation effects of the intake in each of the intake pipes 13L*f*, 13L*r* and 13R*f*, 13R*r* can be equalized. In this manner, charging efficiency for each of the cylinders 8L*f*, 8L*r* and 8R*f*, 8R*r* can be enhanced effectively, and an improvement in engine output can be accomplished. In addition, in the above-mentioned construction, the rear-side valve shafts 15L*a*, 15R*a* nearer to the air cleaner 10 and the front-side valve shafts 15L*b*, 15R*b* farther from the air cleaner 10 can be disposed in parallel to each other.

A third embodiment of the present invention will now be described with reference to FIG. 4.

The third embodiment differs from the second embodiment of FIG. 3 only in the arrangement of valve shafts 15L*a*, 15L*b* and 15R*a*, 15R*b* of throttle valves 14L*a*, 14L*b* and 14R*a*, 14R*b*. Therefore, only the differences between the embodiments will be described. Namely, valve shafts 15L*a*, 15L*b* of throttle valves 14L*a*, 14L*b* disposed in a front-rear relationship on the side of the first bank 7L are connected coaxially with each other. In the embodiment illustrated, the valve shafts are composed of a long common single valve shaft, and a throttle drum 16L connected to an operating wire 17L is attached to one end of the common valve shaft.

In addition, valve shafts 15R*a*, 15R*b* of throttle valves 14R*a*, 14R*b* disposed in a front-rear relationship on the side of the second bank 7R are connected coaxially with each other. In the embodiment illustrated, the valve shafts are composed of a long common single valve shaft, and a throttle drum 16R connected to an operating wire 17R is attached to one end of the common valve shaft.

As a result of the above construction, the valve shafts 15L*a*, 15L*b* of the throttle valves 14L*a*, 14L*b* on the side of the first bank 7L and the valve shafts 15R*a*, 15R*b* of the throttle valves 14R*a*, 14R*b* on the side of the second bank 7R are arranged in a truncated reverse V shape in plan view. Both of the operating wires 17L, 17R mentioned above are connected to a common throttle operating member, not shown, so that they are operated simultaneously. In addition, where the left and right valve shafts 15L*a*, 15L*b* and 15R*a*, 15R*b* are connected to each other through a flexible joint, it suffices that the operating system is provided only for one valve shaft 15L*a*, 15L*b* or 15R*a*, 15R*b*.

According to the above construction, it is possible to accomplish interchangeability between the valve shaft 15L*a*, 15L*b* of the throttle valves 14L*a*, 14L*b* on the side of the first bank 7L and the valve shaft 15R*a*, 15R*b* of the throttle valves 14R*a*, 14R*b* on the side of the second bank 7R. In addition, since the arrangement of the throttle valves 14L*a*, 14L*b* and 14R*a*, 14R*b* is the same as in the second embodiment, the same action or effects as in the second embodiment can be accomplished.

In FIG. 4, the same reference symbols are used for the same component parts described in the first and second embodiments described above.

It should be noted that when an engine E as described above is installed in an air plane 150 as shown in FIG. 5, the engine E is accommodated in a cowl 152 attached to a front portion of a body 151 such that an axial line of the crankshaft 21 extends in the forward and backward direction. Furthermore, the engine E is resiliently supported on a support frame 153 disposed in the cowl 152.

A spinner 155 having a plurality of propellers 154 is disposed forwardly of the cowl 152, and the crankshaft 21 of the engine E is coupled coaxially to the spinner 155.

Referring also to FIG. 6, intake pipes 13L*f*, 13L*f* and 13R*f*, 13R*f* which project from the upper faces of the left and right banks 7L and 7R of the internal combustion engine E extend rearwardly and are connected to an air cleaner 10 disposed rearwardly of the internal combustion engine.

In addition, a suction pipe 158 is connected to a lower portion of the air cleaner 157 and extends forwardly below the engine E. The forward end of the suction pipe 158 is open to a screen 159 provided at a lower portion of the front end of the cowl 152.

A pair of radiators 160, 160 is disposed on the opposite left and right sides of a lower portion of the engine E. The radiators 160, 160 are accommodated in a pair of first air ducts 161, 161, which extends forwardly upwards. The lower ends of the first air ducts 161, 161 are open obliquely rearwards in the cowl 152. A second air duct 162 is connected in common to the upper ends of the two first air ducts 161, 161. The second air duct 162 includes a common duct portion 162*a* extending leftwardly and rightwardly below a front portion of the engine E and having, at a front and central portion thereof, and air intake opening 163 opposed to the screen 159. A pair of branch duct portions 162*b*, 162*b* extend rearwardly upwards from the opposite left and right end portions of the common duct portion 162*a* and connect to the upper ends of the first air ducts 161, 161.

In particular, the radiators 160, 160 disposed on the opposite left and right sides of a lower portion of the engine E are cooled by air fed from the screen 159 at the front end of the cowl 152 to the air intake opening 163 by the propellers 154 and flowing through the left and right first air ducts 161, 161 separately from the second air duct 162.

The support frame 153 is formed from; for example, a plurality of pipe members combined in such a manner as to embrace the engine E from the rear. In addition; for example, mounting arms 164, 164 are inclined such that the distances between them increase rearwardly at four locations of a rear portion of the crankcase 19 of the engine E. The mounting arms 164, 164 are provided such that they may be positioned at the corners of an imaginary rectangular parallelepiped centered at the axial line of the crankshaft 21 in a plane perpendicular to the axial line. The mounting arms 164, 164, are mounted on the support frame 153 through resilient mounts 165, 165.

Referring to FIG. 7, each resilient mount 165 includes a cylindrical collar 166, a cylindrical support tube 167 fixed to the support frame 153 and coaxially surrounding the collar 166, and a mount rubber member 168 interposed between the collar 166 and the support tube 167 with inner and outer peripheries thereof baked to an outer periphery of the collar 166 and an inner periphery of the support tube 167. Opposite ends of the collar 166 project from the opposite ends of the support tube 167

The collar 166 has one end contacting with a mounting arm 164. The collar 166 contacts, at the other end thereof, with a holding down plate 169. A bolt 170 has an increased diameter head portion 170*a* for engaging with an outer face of the holding down plate 169 and extending through the holding down plate 169 and the collar 166. The bolt 170 is screwed in the mounting arm 164 such that the mounting arm 164, i.e., the engine E, is resiliently mounted on the support frame 153 by tightening the bolt 170.

The present invention is not restricted to or by the above-mentioned embodiments, and various modifications in design can be made without stepping out of the gist of the invention. For instance, the first and second intake ports 9L*f*, 9L*r* and 9R*f*, 9R*r* can be opened at bottom surfaces of head portions of the first and second banks 7L, 7R, and the first and second intake pipes 13L*f*, 13L*r* and 13R*f*, 13R*r* can be disposed along a bottom surface of the engine E. In addition, the horizontally opposed type internal combustion engine according to the present invention can be applied to internal combustion engines having 6 or more cylinders. Furthermore, by disposing the crankshaft along a center line of a vehicle, the horizontally opposed type internal combustion engine of the present invention can effectively be applied to automobiles, motorcycles and airplanes.

According to the first characteristic feature of the present invention as described above, a horizontally opposed type internal combustion engine includes first and second banks disposed horizontally and opposite to each other with a crankshaft therebetween. First and second intake ports are provided at head portions of the first and second banks. A side wall on the crankshaft side of an air cleaner disposed horizontally adjacent to and on one end side of the crankshaft is provided with first and second intake distribution ports corresponding to the first and second intake ports and arranged horizontally. The first and second intake ports and the first and second intake distribution ports are connected respectively to each other through first and second intake pipes disposed along a top surface or a bottom surface of the engine. Throttle valves for controlling intake quantities in the first and second intake pipes are provided in respective upstream portions of the intake pipes. With this construction, it is possible to prevent intake interference among the cylinders, to enhance charging efficiency, and accomplish an improvement in output performance of the engine. In addition, the air cleaner disposed horizontally adjacent to and at the rear end of the crankshaft and the first and second intake pipe disposed along the top surface or bottom surface of the engine do not have a great influence on the overall height of the engine. Accordingly, it is possible to retain the intrinsic merit of the horizontal opposed type internal combustion engine such that the overall height of the engine can be made small.

According to the second characteristic feature of the invention, first and second banks include pluralities of first and second cylinders and pluralities of first and second intake ports corresponding to the first and second cylinders. Pluralities of first and second intake distribution ports provided in an air cleaner corresponding to the first and second intake ports are arranged symmetrically with respect to a center line extending in the vicinity of and in parallel with the crankshaft. The first and second intake ports nearer to the air cleaner and the first and second intake distribution ports located on the inner side and nearer to the center line are connected respectively to each other through the first and second intake pipes. The first and second intake ports farther from the air cleaner and the first and second intake distribution ports located on the outer side and farther from the center line are connected respectively to each other through the first and second intake pipes. Valve shafts of throttle valves provided in upstream portions of the first and second intake pipes are connected coaxially with each other. As a result, although the distances between the front-side and rear-side intake ports and the air cleaner differ in each bank, evening of effective pipe lengths of the first intake pipes and evening of effective pipe lengths of the second intake pipes can be accomplished, and inertia effects and pulsation effects of the intake are equally displayed in each of the intake pipes. In this manner, it is possible to effectively enhance the charging efficiency for each cylinder, and to accomplish a further improvement of output performance.

According to the third characteristic feature of the present invention, first and second banks include pluralities of first and second cylinders and pluralities of first and second intake ports corresponding to the first and second cylinders. Pluralities of first and second intake distribution ports provided in the air cleaner corresponding to the first and second intake ports are arranged symmetrically with respect to a center line extending in the vicinity of and in parallel with the crankshaft. The first and second intake ports nearer to the air cleaner and the first and second intake distribution ports located on the outer side and farther from the center line are connected respectively to each other through first and second intake pipes. The first and second intake ports farther from the air cleaner and the first and second intake distribution ports located on the inner side and nearer to the center line are connected respectively to each other through the first and second intake pipes. Throttle valves provided in upstream portions of the first and second intake pipes connected to the first and second outer-side intake distribution ports are arranged nearer to the air cleaner as compared to throttle valves provided in upstream portions of the first and second intake pipes connected to the first and second inner-side intake distribution ports. In this case, evening of effective pipe lengths of the first intake pipes and evening of effective pipe lengths of the second intake pipes can be accomplished, and inertia effects and pulsation effects of the intake are equally displayed in each of the intake pipes. In this manner, it is possible to effectively enhance the charging efficiency for each cylinder, and to accomplish a further improvement of output performance.

Furthermore, according to the third characteristic feature of the present invention, valve shafts of the throttle valves nearer to the air cleaner are connected coaxially with each other, and valve shafts of throttle valves farther from the air cleaner are connected coaxially with each other. Therefore, it is possible to arrange in parallel the valve shafts of the throttle valves nearer to the air cleaner and the valve shafts of the throttle valves farther from the air cleaner.

According to the fourth characteristic feature of the present invention, valve shafts of the throttle valves in the first intake pipes are connected coaxially with each other, and valve shafts of the throttle valves in the second intake pipes are connected coaxially with each other. With this construction, it is possible to accomplish interchangeability between the valve shafts of the throttle valves in the first intake pipe and the valve shafts of the throttle valves in the second intake pipe.

Furthermore, according to the sixth characteristic feature of the present invention, the first bank is set off from the second bank to the opposite side of the air cleaner along the axis line of the crankshaft, and the above-mentioned center line is set off from the axis line of the crankshaft to the side of the first bank. With this arrangement, it is possible to reduce pipe length difference between the first intake pipes and the second intake pipes due to the offset of the first and second banks from each other, and to contribute to evening of effective pipe lengths of the intake pipes.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An intake system for a horizontally opposed type internal combustion engine, the engine including a first bank and a second bank horizontally disposed opposite to each other with a crankshaft therebetween, said intake system comprising:

first and second intake ports, said first and second intake ports being provided at head portions of the first and second banks;

a side wall; said side wall being provided on the crankshaft side of an air cleaner of the engine, said side wall being disposed adjacent to the crankshaft and being provided with first and second intake distribution ports corresponding to said first and second intake ports, said first and second intake distribution ports being arranged horizontally;

first and second intake pipes, said first and second intake pipes respectively connecting said first and second intake ports and said first and second intake distribution ports to each other, and being disposed along a top surface or a bottom surface of the engine; and first and second throttle valves for controlling intake quantities in said first and second intake pipes, said throttle valves being provided in respective upstream portions of said first and second intake pipes.

2. The intake system for a horizontally opposed type internal combustion engine according to claim 1, wherein the first and second banks further comprise pluralities of first and second cylinders, said intake system further comprising:

pluralities of said first and second intake ports corresponding to the first and second cylinders;

pluralities of said first and second intake distribution ports provided in said air cleaner corresponding to said first and second intake ports, said pluralities of said first and second intake distribution ports being arranged symmetrically with respect to a center line extending in a vicinity of and in parallel with the crankshaft;

a first pair of said pluralities of first and second intake ports nearer to said air cleaner and a first pair of said pluralities of first and second intake distribution ports located on an inner side and nearer to said center line are connected respectively to each other through a first pair of pluralities of said first and second intake pipes;

a second pair of said pluralities of first and second intake ports farther from said air cleaner and a second pair of said pluralities of first and second intake distribution ports located on an outer side and farther from said center line are connected respectively to each other through a second pair of said pluralities of first and second intake pipes; and pluralities of first and second valve shafts, pluralities of said first and second throttle valves provided in said upstream portions of pluralities of said first and second intake pipes are connected coaxially with each other by said pluralities of first and second valve shafts.

3. The intake system for a horizontally opposed type internal combustion engine according to claim 1, wherein the first and second banks further comprise pluralities of first and second cylinders, said intake system further comprising:

pluralities of said first and second intake ports corresponding to the first and second cylinders;

pluralities of said first and second intake distribution ports provided in said air cleaner corresponding to said first and second intake ports, said pluralities of said first and second intake distribution ports being arranged symmetrically with respect to a center line extending in a vicinity of and in parallel with the crankshaft;

a first pair of said pluralities of first and second intake ports nearer to said air cleaner and a first pair of said pluralities first and second intake distribution ports located on an outer side and farther from said center line are connected respectively to each other through a first pair of pluralities of said first and second intake pipes;

a second pair of said pluralities of first and second intake ports farther from said air cleaner and a second pair of said pluralities of first and second intake distribution ports located on an inner side and nearer to said center line are connected respectively to each other through a second pair of said pluralities of first and second intake pipes; and pluralities of said first and second throttle valves provided in said upstream portions of pluralities of said first and second intake pipes connected to said first pair of said pluralities of first and second intake distribution ports are arranged nearer to said air cleaner than said throttle valves provided in said upstream portions of said pluralities of first and second intake pipes connected to said second pair of said pluralities of first and second intake distribution ports.

4. The intake system for a horizontally opposed type internal combustion engine according to claim 3, wherein said valve shafts of said throttle valves nearer to the air cleaner are connected coaxially with each other, and said valve shafts of said throttle valves farther from the air cleaner are connected coaxially with each other.

5. The intake system for a horizontally opposed type internal combustion engine according to claim 3, wherein said valve shafts of said throttle valves in said first intake pipes are connected coaxially with each other, and said valve shafts of said throttle valves in said second intake pipes are connected coaxially with each other.

6. The intake system for a horizontally opposed type internal combustion engine according to claim 1, wherein said first bank is set off from said second bank to an opposite side of the air cleaner along the axis line of the crankshaft, and said center line is set off from said axis line of the crankshaft to a side of the first bank.

7. The intake system for a horizontally opposed type internal combustion engine according to claim 2, wherein the first bank is set off from the second bank to an opposite side of the air cleaner along the axis line of the crankshaft, and said center line is set off from said axis line of the crankshaft to a side of the first bank.

8. The intake system for a horizontally opposed type internal combustion engine according to claim 3, wherein the first bank is set off from the second bank to an opposite side of the air cleaner along the axis line of the crankshaft, and said center line is set off from said axis line of the crankshaft to a side of the first bank.

9. The intake system for a horizontally opposed type internal combustion engine according to claim 4, wherein the first bank is set off from the second bank to an opposite side of the air cleaner along the axis line of the crankshaft, and said center line is set off from said axis line of the crankshaft to a side of the first bank.

10. The intake system for a horizontally opposed type internal combustion engine according to claim 5, wherein the first bank is set off from the second bank to an opposite side of the air cleaner along the axis line of the crankshaft, and said center line is set off from said axis line of the crankshaft to a side of the first bank.

11. A horizontally opposed type internal combustion engine, comprising:

a crankshaft having a plurality of cranks formed thereon;

a plurality of pistons, said plurality of pistons being operably connected to said crankshaft for reciprocation;

a first bank and a second bank horizontally disposed opposite to each other with said crankshaft therebetween;

an air cleaner; and an intake system, said intake system comprising:

first and second intake ports, said first and second intake ports being provided at head portions of said first and second banks;

a side wall; said side wall being provided on the crankshaft side of said air cleaner, said side wall being disposed adjacent to said crankshaft and being provided with first and second intake distribution ports corresponding to said first and second intake ports, said first and second intake distribution ports being arranged horizontally;

first and second intake pipes, said first and second intake pipes respectively connecting said first and second intake ports and said first and second intake distribution ports to each other, and being disposed along a top surface or a bottom surface of the engine; and first and second throttle valves for controlling intake quantities in said first and second intake pipes, said throttle valves being provided in respective upstream portions of said first and second intake pipes.

12. The horizontally opposed type internal combustion engine according to claim 11, wherein said first and second banks further comprise pluralities of first and second cylinders, said intake system further comprising:

pluralities of said first and second intake ports corresponding to the first and second cylinders;

pluralities of said first and second intake distribution ports provided in said air cleaner corresponding to said first and second intake ports, said pluralities of said first and second intake distribution ports being arranged symmetrically with respect to a center line extending in a vicinity of and in parallel with said crankshaft;

a first pair of said pluralities of first and second intake ports nearer to said air cleaner and a first pair of said pluralities of first and second intake distribution ports located on an inner side and nearer to said center line are connected respectively to each other through a first pair of pluralities of said first and second intake pipes;

a second pair of said pluralities of first and second intake ports farther from said air cleaner and a second pair of said pluralities of first and second intake distribution ports located on an outer side and farther from said center line are connected respectively to each other through a second pair of said pluralities of first and second intake pipes; and pluralities of first and second valve shafts, pluralities of said first and second throttle valves provided in said upstream portions of pluralities of said first and second intake pipes are connected coaxially with each other by said pluralities of first and second valve shafts.

13. The horizontally opposed type internal combustion engine according to claim 11, wherein said first and second banks further comprise pluralities of first and second cylinders, said intake system further comprising:

pluralities of said first and second intake ports corresponding to said first and second cylinders;

pluralities of said first and second intake distribution ports provided in said air cleaner corresponding to said first and second intake ports, said pluralities of said first and second intake distribution ports being arranged symmetrically with respect to a center line extending in a vicinity of and in parallel with said crankshaft;

a first pair of said pluralities of first and second intake ports nearer to said air cleaner and a first pair of said pluralities first and second intake distribution ports located on an outer side and farther from said center line are connected respectively to each other through a first pair of pluralities of said first and second intake pipes;

a second pair of said pluralities of first and second intake ports farther from said air cleaner and a second pair of said pluralities of first and second intake distribution ports located on an inner side and nearer to said center line are connected respectively to each other through a second pair of said pluralities of first and second intake pipes; and pluralities of said first and second throttle valves provided in said upstream portions of pluralities of said first and second intake pipes connected to said first pair of said pluralities of first and second intake distribution ports are arranged nearer to said air cleaner than said throttle valves provided in said upstream portions of said pluralities of first and second intake pipes connected to said second pair of said pluralities of first and second intake distribution ports.

14. The horizontally opposed type internal combustion engine according to claim 13, wherein said valve shafts of said throttle valves nearer to said air cleaner are connected coaxially with each other, and said valve shafts of said throttle valves farther from said air cleaner are connected coaxially with each other.

15. The horizontally opposed type internal combustion engine according to claim 13, wherein said valve shafts of said throttle valves in said first intake pipes are connected coaxially with each other, and said valve shafts of said throttle valves in said second intake pipes are connected coaxially with each other.

16. The horizontally opposed type internal combustion engine according to claim 11, wherein said first bank is set off from said second bank to an opposite side of said air cleaner along the axis line of said crankshaft, and said center line is set off from said axis line of said crankshaft to a side of said first bank.

17. The horizontally opposed type internal combustion engine according to claim 12, wherein said first bank is set off from said second bank to an opposite side of said air cleaner along the axis line of said crankshaft, and said center line is set off from said axis line of said crankshaft to a side of said first bank.

18. The horizontally opposed type internal combustion engine according to claim 13, wherein said first bank is set off from said second bank to an opposite side of said air cleaner along the axis line of said crankshaft, and said center line is set off from said axis line of said crankshaft to a side of said first bank.

19. The horizontally opposed type internal combustion engine according to claim 14, wherein said first bank is set off from said second bank to an opposite side of said air cleaner along the axis line of said crankshaft, and said center line is set off from said axis line of said crankshaft to a side of said first bank.

20. The horizontally opposed type internal combustion engine according to claim 15, wherein said first bank is set off from said second bank to an opposite side of said air cleaner along the axis line of said crankshaft, and said center line is set off from said axis line of said crankshaft to a side of said first bank.

* * * * *